United States Patent [19]

Ray et al.

[11] 4,445,805

[45] May 1, 1984

[54] JACK-UP PLATFORM VARIABLE BEARING ASSEMBLY

[75] Inventors: Donald R. Ray, Houston, Tex.; Eugene R. Facey, London, England

[73] Assignee: Sonat Offshore Drilling Inc., Houston, Tex.

[21] Appl. No.: 442,463

[22] Filed: Nov. 17, 1982

[51] Int. Cl.[3] ..... E02B 17/00

[52] U.S. Cl. ..... 405/203; 405/195; 405/196

[58] Field of Search ..... 405/195–201, 405/203–208, 224–227; 175/5, 7; 166/342, 343

[56] References Cited

U.S. PATENT DOCUMENTS

| | | | |
|---|---|---|---|
| 2,589,146 | 3/1952 | Samuelson | 405/208 |
| 2,927,436 | 3/1960 | Besse . | |
| 2,936,592 | 5/1960 | Suderow | 405/208 |
| 3,029,608 | 4/1962 | Perkins | 405/208 |
| 3,183,676 | 5/1965 | Le Tourneau | 405/196 |
| 3,401,917 | 9/1968 | Bradbury | 405/197 X |
| 3,611,734 | 10/1971 | Mott . | |
| 3,628,336 | 12/1971 | Moore | 405/196 |

*Primary Examiner*—Dennis L. Taylor
*Attorney, Agent, or Firm*—Bradford E. Kile

[57] ABSTRACT

A variable bearing assembly (40) for a jack-up platform having a hull (12), at least one support leg (14) and jack means (16) to effect relative vertical movement between the hull and support leg wherein the variable bearing assembly (40) includes; a bearing pad or foot (42) surrounding the distal end of the support leg (14) and a lost motion assembly (62, 68) interconnecting the bearing pad and support leg such that the support leg may vertically penetrate the seabed to refusal while the bearing pad is essentially supported on the surface of the seabed.

15 Claims, 8 Drawing Figures

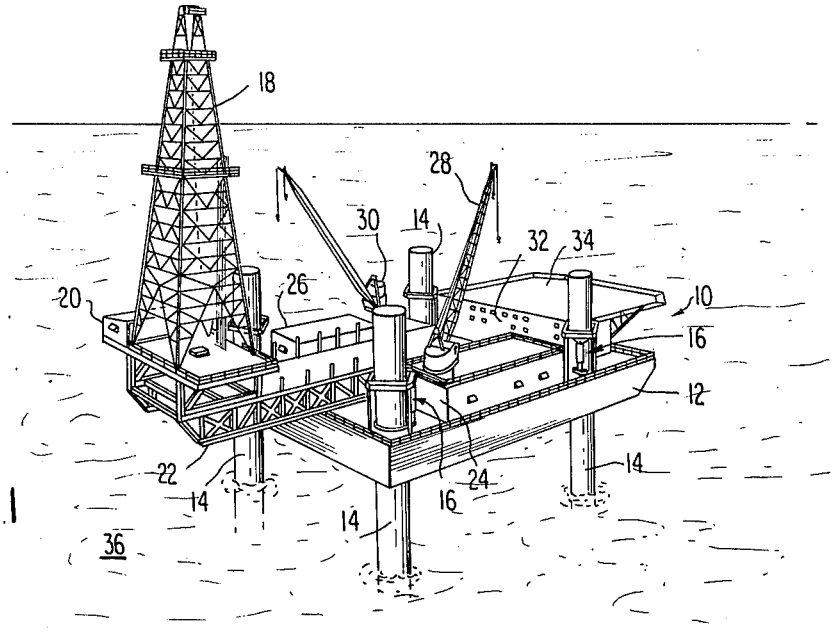
FIG.1
FIG.2
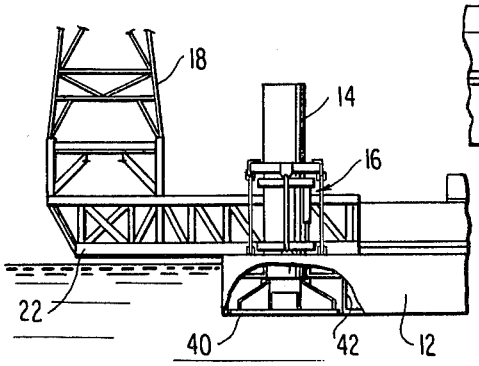
FIG.3
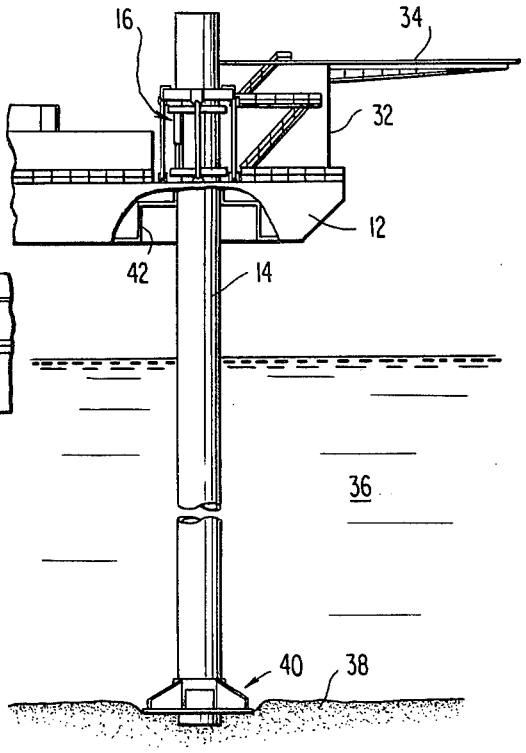

JACK-UP PLATFORM VARIABLE BEARING ASSEMBLY

BACKGROUND OF THE INVENTION

This invention relates to a variable bearing assembly. More specifically, the subject invention relates to an apparatus for providing a variable vertical and lateral bearing for a support leg of an offshore jack-up platform.

In the past, offshore platforms or towers have been extensively utilized around and upon the continental shelf regions of the world. Examples of offshore platform facilities include supports for radar stations, light beacons, scientific and exploration laboratories, chemical plants, power generating plants, mining stations, etc. Principally, however, offshore platforms have been utilized by the oil and gas industry in connection with drilling, production and/or distribution operations.

In conducting such offshore activity, several platform designs have been utilized by the industry. In deep water applications, semi-submersibles or drillships, which are dynamically positioned and/or turret moored over a well site, have been effectively employed. Although semi-submersibles and drillships are highly mobile and widely utilized in deep water applications, the initial cost and subsequent operating expense reduces the desirability of such units for use in shallow water or intermediate depth applications.

In shallow water situations, fixed length towers or platforms have been extensively utilized. Such platforms are normally fabricated on shore and transported in a generally horizontal posture to an offshore site upon a barge or buoyancy chambers within the platform legs. On site, the platform is pivoted into an upright posture and the base is positioned into firm bearing engagement with the seabed. A platform deck is then fabricated upon the erected tower for conducting offshore operations. Such fixed platforms, although economical in relatively shallow water, require considerable time to assemble and once in position are difficult to relocate.

One platform design which combines many of the advantages of floating and fixed equipment is known as a "jack-up" platform. In this connection a jack-up platform typically comprises a barge or self propelled hull operable to function in a conventional flotation capacity during transportation and as a working deck on location. The hull is fitted with one or more legs which are operable to be vertically extended downward from the deck and into supporting engagement with the seabed.

In operation a jack-up platform is either towed or navigated to a desired offshore site with the jack-up legs extending through wells fashioned through the hull. On site the legs are jacked downward into firm bearing engagement with the seabed. Further jacking serves to raise the hull/deck with respect to the surface of the body of water. Once the lowermost portion of the deck is elevated above a statistical storm wave height, jacking is discontinued and drilling and/or production operations are begun from the elevated deck. Upon completion of the desired offshore operations the deck is jacked down to the surface of the body of water and the legs are jacked up. The platform is then towed or navigated to another working station and the process is repeated. Because of its mobility and versatility, jack-up platforms have emerged as one of the most desirable forms of platform design in the industry.

The subject invention is specifically directed to a jack-up platform variable bearing assembly wherein a novel lost motion footing assembly provides enhanced vertical and lateral stability to a platform leg and in addition facilitates transportation of the platform to a working site and retrieval of the platform legs following working at the site.

The seabed is composed of variant soils and deposits but typically the seabed has a relatively soft upper surface with varying layers of firmer soil strata as the upper layer is penetrated. In some instances relatively loose soils extend downwardly several feet from the surface and in other locations rock or very firm soils lie rather shallow beneath the surface of the seabed.

In order to securely support a jack-up platform in the open sea it is desirable in one sense to provide a fairly large footing at the end of each leg so that vertical loads can be spread over an enlarged area to prevent the leg from penetrating too deeply into the seabed and becoming imbedded. At the same time it is desirable to provide at least a degree of vertical penetration of the leg to enhance lateral stability of the bearing arrangement. Still further it is desirable to be able to tow a platform to a working site in a condition wherein the legs do not project downwardly from the platform hull and thus provide an undesirable hydrodynamic drag.

A significant advance in the art of supporting jack-up platforms was achieved by the conception and development of a tank footing such as disclosed in Moore et al. U.S. Pat. No. 3,628,336 assigned to the assignee of the subject invention. The disclosure of this Moore et al. patent is incorporated herein by reference as though set forth at length. Briefly, however, the Moore et al. patent discloses a tank footing which is releasably connected within a well recessed into the platform hull around each leg. According to the Moore et al. disclosure if the bottom surface is firm the tank footings are not used and they remain connected to the hull. If, however, looser soils are encountered the tank footings are connected to the platform legs in a position above the end of the legs to provide a combination effect of penetration by the leg for lateral stability and vertical bearing over an enlarged footing area. Following operations the leg and footing are jacked back to the hull for transport to a new working site.

Notwithstanding the advantages provided by the foregoing Moore et al. design, room for significant improvement remains. In this regard it would be highly desirable to provide a variable bearing assembly for a jack-up platform that could advantageously be used with a variety of seabed soils while providing enhanced lateral stability for the bearing assembly. Further it would be advantageous to provide a bearing assembly for a jack-up platform which would facilitate removal of the platform leg from the seabed following site operations.

The difficulties suggested in the preceding are not intended to be exhaustive, but rather are among many which may tend to limit the effectiveness and satisfaction with prior platform bearing systems. Other noteworthy problems may also exist; however, those presented above should be sufficient to demonstrate that prior jack-up platform bearing assemblies will admit to worthwhile improvement.

OBJECTS OF THE INVENTION

It is therefore a general object of the invention to provide a novel jack-up platform bearing assembly which will obviate or minimize difficulties, while concomitantly achieving desired advantages, of the type previously described.

It is a specific object of the invention to provide a novel jack-up platform bearing assembly which will operably accommodate a variety of seabed soil bearing conditions.

It is a related object of the invention to provide a novel jack-up platform bearing assembly which will permit a variable degree of vertical leg penetration within a seabed while providing enhanced lateral stability of the bearing assembly.

It is another object of the invention to provide a novel jack-up platform bearing assembly wherein the depth of vertical leg penetration may be advantageously limited in loose seabed soils.

It is yet another object of the invention to provide a novel jack-up platform bearing assembly wherein retrieval of the platform leg following site operations will be enhanced.

It is still another object of the invention to provide a novel jack-up platform bearing assembly wherein hydrodynamic drag of jack-up platform legs is minimized during transport of the platform to a working station.

BRIEF SUMMARY OF A PREFERRED EMBODIMENT OF THE INVENTION

A preferred embodiment of the invention which is intended to accomplish the foregoing objects comprises a variable bearing assembly for a jack-up platform having a hull, at least one support leg and jacking means to effect relative verticial movement between the hull and leg.

The variable bearing assembly includes a bearing member or pad which is carried by and surrounds the distal end of the platform support leg. A guide member is mounted upon the bearing member and surrounds the support leg for providing a sliding guidance of the bearing member along the distal end of the support leg. An interconnecting assembly extends between the guide and support leg and provides a degree of longitudinal lost motion between the guide and support leg such that the bearing member operably enhances the lateral stability to the support leg and in most instances exhibits vertical bearing capability as the support leg penetrates into the seabed to the limit of the lost motion connection.

Another aspect of the subject invention is the provision of a release assembly mounted upon the bearing member which includes a mechanical advantage unit which is operable to selectively disengage the interconnecting member extending between the guide and distal end of the platform leg such that in instances where the bearing member has been silted over during platform operations and/or has become otherwise firmly imbedded within the loose soil formation of the seabed the interconnecting member may be withdrawn and the platform leg drawn up through the bearing member for retrieval while leaving the bearing pad portion of the variable bearing assembly imbedded within the seabed.

THE DRAWINGS

Other objects and advantages of the present invention will become apparent from the following detailed description of a preferred embodiment thereof taken in conjunction with the accompanying drawings, wherein:

FIG. 1 is an axonometric view of an offshore jack-up platform of the type operable to advantageously utilize the subject invention;

FIG. 2 is a partial cross-sectional view of the offshore platform wherein a variable bearing assembly, in accordance with the invention, is shown drawn into a recess within the platform hull during a transport operation;

FIG. 3 is a partial cross-sectional view of a jack-up platform wherein a variable bearing assembly, in accordance with the invention, is mounted at a distal end of a support leg of the platform and is operably stationed upon a seabed;

Figure 4:
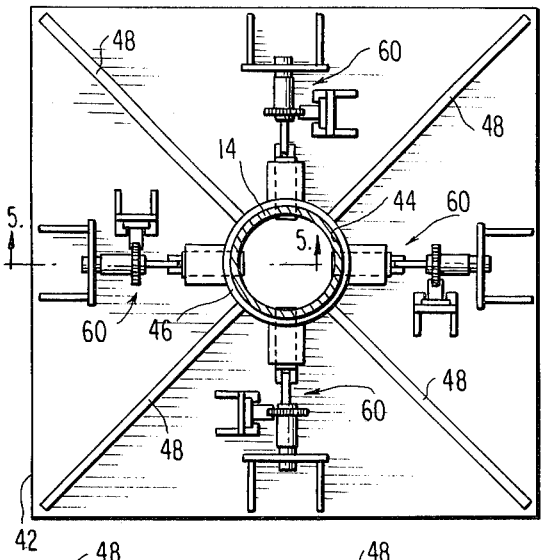
Figure 6:
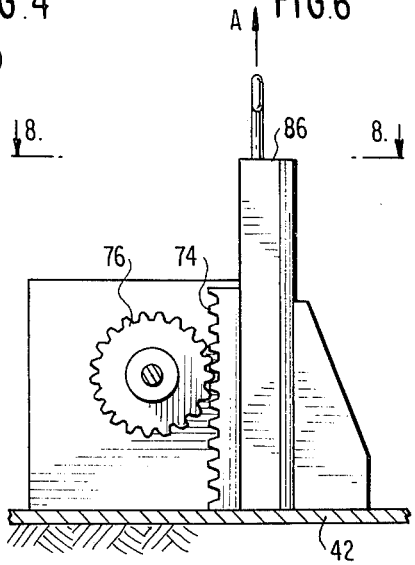
Figure 7:
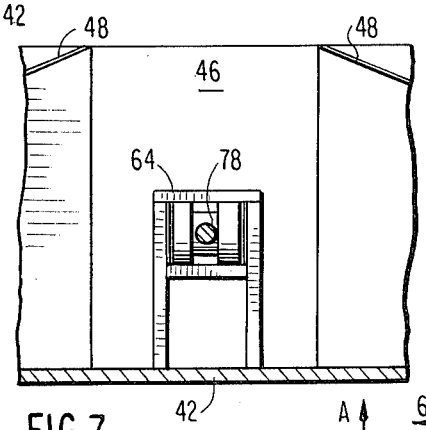
Figure 8:
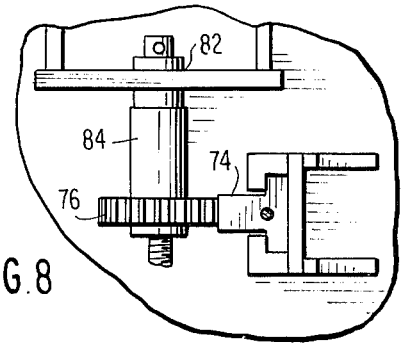
Figure 5:
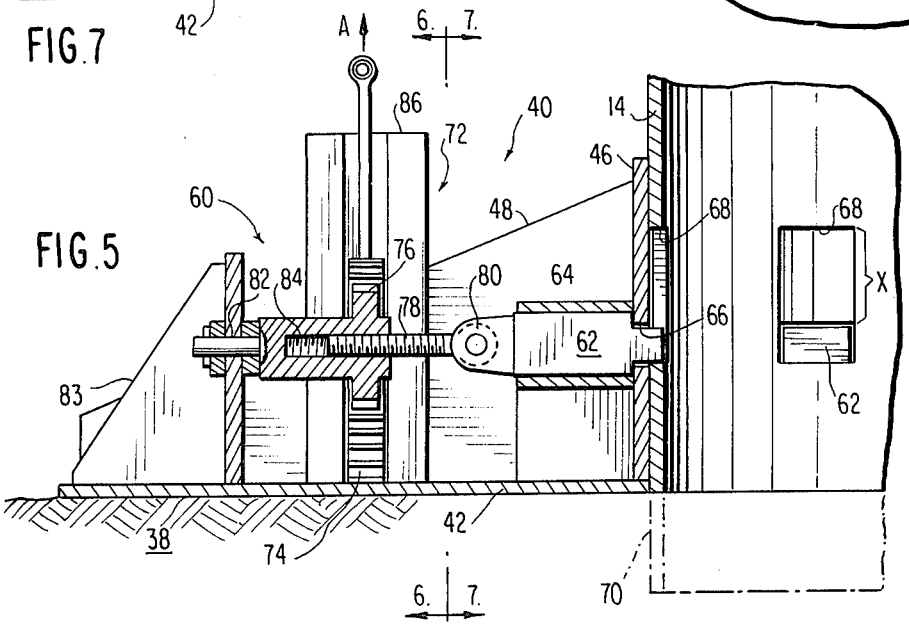

FIG. 4, note sheet 2, is a detailed plan view of a preferred embodiment of the subject variable bearing assembly;

FIG. 5 is an enlarged, partial, cross-sectional view taken along section lines 5—5 in FIG. 4 and discloses a lost motion interconnecting assembly between a bearing member and a platform leg in accordance with the invention;

FIG. 6 is a partial, cross-sectional view taken along section line 6—6 in FIG. 5 and discloses a rack and pinion actuating member;

FIG. 7 is a partial, cross-sectional view taken along section line 7—7 in FIG. 5; and FIG. 8 is a detailed view taken along section line 8—8 in FIG. 6.

DETAILED DESCRIPTION

Context of the Invention

Referring now to the drawings and particularly to FIG. 1 there will be seen an axonometric representation of a jack-up offshore platform of the type operable to advantageously utilize the subject variable bearing assembly. Although the subject invention may be employed with a plurality of jack-up platform designs the platform depicted in FIG. 1 is believed to be representative and includes a hull 12 which carries a plurality of legs 14 normally extending through the hull and a jacking assembly 16 which is operable to effect relative vertical motion of the legs 14 with respect to the hull. A number of different jacking assemblies 16 may be utilized to raise and lower the leg 14 with respect to the hull. One jacking assembly which has been advantageously utilized in the past is disclosed in a Bradbury U.S. Pat. No. 3,401,917, assigned to the assignee of the subject invention.

The hull 12 is typically fitted with a number of pieces of equipment to conduct drilling operations. Representative equipment includes a derrick 18 and draw works 20 which is mounted upon a centilever assembly 22 extending outwardly from the deck of the hull 12. A generator house 24 is mounted upon one lateral portion of the deck and a hydraulic power and fresh water system 26 is mounted upon a corresponding lateral location of the deck. A large 28 and small 30 crane is pedistal mounted upon the deck for handling equipment, drill pipe, casing and the like. Further, crew quarters 32 are provided at a forward end of the platform beneath a heliport 34. Without unduly belaboring the above by a complete recitation of the operating equipment on a conventional jack-up platform, it should be appreciated that an operating platform carries thousands of tons of equipment and supplies above the surface of a body of water for an extended period of time and must be securely supported by the legs 14 which extend through an underlying body of water 36 and into the seabed 38.

In order to carry the tremendous loads of a working offshore platform, a variable bearing assembly 40 is mounted at a distal end of each leg 14. Turning to FIG. 2 the hull 12 is fashioned with a recess or well 42 around each leg location and operably receives the variable bearing assembly 40 such that the bottom portion of the assembly is approximately flush with a lowermost portion of the hull 12 during transportation. Accordingly, hydrodynamic drag on the platform during flotation is minimized. On site the jacking asssemblies 16 are actuated and each support leg 14 including its variable bearing assembly 40 is jacked downwardly through the body of water 36 and into supporting engagement with the seabed 38 as depicted in FIG. 3.

Variable Bearing Assembly

Turning now to FIGS. 4 and 5, note sheet 2, there will be seen various views of a variable bearing assembly 40 in accordance with a presently preferred embodiment of the invention. More specifically the variable bearing assembly includes a bearing member or pad 42 which may be square in peripheral configuration, as depicted in FIG. 4, round or fashioned with an intermediate orthogonal exterior as desired. The bearing member 42 includes a central aperature 44 for intimately receiving a platform leg 14. In the subject embodiment the platform support leg 14 has been depicted as a hollow cylindrical member. Other leg configurations may be utilized, however, and in such cases it should be appreciated that the aperature 44 will be fashioned to conform to the exterior contour of those various support leg designs.

A guide member 46 is mounted upon the bearing member 42 and includes an interior surface which is compatible with the exterior surface of the support leg 14; which in the instance of the instant disclosure is a cylindrical member. As depicted in FIG. 5 it will be appreciated that the guide 46 has a longitudinal dimension and extends upwardly from the bearing member 42 to slidingly, yet intimately, surround the platform support leg 14. This guide 46 operably permits the bearing assembly to longitudinally translate along the distal end of the support leg. In the embodiment depicted in FIGS. 4 and 5 the guide member is supported with respect to the bearing member 42 by a plurality of bracing plates 48. The particular configuration of the bracing assembly is not considered to be critical and other forms of brace arrangements suitable to maintain the structural integrity of the guide 46 with respect to the bearing member 42 will be recognized by those skilled in the art.

An interconnecting assembly 60 is mounted upon the bearing member and advantageously is utilized to releasably connect the bearing member 42 and guide 46 with the support leg 14. The interconnecting assembly 60 includes a load bearing pin 62 which is mounted for horizontal translation within a transverse guide 64. The load pin 62 extends through an aperature 66 within the guide member 46 and into an elongate aperature or recess 68 cut into the distal end of the platform leg 14. Although a preferred embodiment of the invention discloses a recess in the support leg 14 and a load bearing pin 62 carried by the bearing assembly this structural relationship may be reversed with a recesse fashioned into the guide 46 of the bearing assembly which would be operable to receive a load bearing pin or protrusion extending radially outwardly from the support leg 14.

As seen in FIG. 4 a plurality of interconnecting assemblies 60 are preferably mounted about the bearing member and symmetrically and selectively interconnect the variable bearing assembly with the platform support leg 14. In a preferred embodiment the pin 62 is generally rectangular in cross-section, note FIG. 5, and the aperature 68 has a compatible configuration and includes a longitudinal degree of travel or lost motion "X". The length of the recess, and thus lost motion, may vary but is generally defined at its lower limit by the distance of the guide member below the load pin 62 and at its upper end by the maximum desired distance it is determined that the particular support leg configuration should be permitted to cut into the seabed. In instances where relatively loose bearing material is encountered the bearing member 42 will engage the seabed 38 and the support leg 14 will slide along the guide 46 downwardly a further distance of lost motion "X" and cut into the seabed as depicted in phantom at 70 in FIG. 5.

In order to selectively actuate the load pin 62 the interconnecting assembly 60 includes, in a presently preferred embodiment, a mechanical advantage actuating mechanism 72. This actuating mechanism includes a rack 74 which mates with a compatible pinion gear 76 mounted for rotation about a threaded connector 78. The connector 78 in turn is pivotally mounted as at 80 to a remote end of the engaging pin 62. The pinion gear 76 is mounted for coaxial rotation as at 82 by an upright frame 83 and is fashioned with an internally threaded hub portion 84 to receive the link 78. The rack itself is constrained within a vertical guide 86 and upon mechanical pulling action in the direction of arrow A, note FIGS. 5 and 6, the pinion gear 76 will rotate and withdraw the load pin 62 from engagement with recess 68 in the supporting leg 14. When the pin is withdrawn it will be appreciated by those skilled in the art that the leg 14 will be free to be pulled up through the variable bearing assembly and to the platform deck; leaving the bearing assembly imbedded within the seabed.

Although the presently preferred embodiment discloses a rack and pinion mechanical advantage release mechanism other assemblies which provide mechanical leverage for release of the load pin 62 are contemplated. Moreover, hydraulic, air or explosive release assemblies may be utilized with the subject variable bearing assembly to selectively release the load bearing pin 62.

SUMMARY OF MAJOR ADVANTAGES OF THE INVENTION

After reading and understanding the foregoing description of a preferred embodiment of the invention, in conjunction with the drawings, it will be appreciated that several distinct advantages of the subject variable bearing assembly for a jack-up platform are obtained. Without attempting to set forth all of the desirable features of the instant invention as specifically and inherently disclosed above, at least one illustrative advantage comprises a unique combination of a bearing member and a lost motion connection assembly between a guide mounted upon the bearing member and the distal end of an offshore platform leg. By the provision of this lost motion connection the platform leg can cut into the seabed a varying distance depending upon the point of refusal of the soil and the lateral bearing member will provide an enhanced degree of lateral stability during the lost motion segment. In those instances when the entire lost motion segment is taken up before the bottom of the support leg reaches the point of soil bearing refusal the bearing member advantageously spreads the vertical load over an enlarged bearing area.

The variable bearing assembly is releasably connected to the distal end of the platform leg so that in the event that the bearing assembly becomes silted over or imbedded within an upper surface of the seabed it may be faciley left on site by retracting the connecting load pins and allowing the platform support leg to be withdrawn to the surface with relative ease.

The load bearing pin assembly may be advantageously retracted by a mechanical advantage actuating assembly which in a preferred embodiment comprises a rack and pinion mechanism.

In describing the invention, reference has been made to a preferred embodiment and illustrative advantages of the invention. Those skilled in the art, however, and familiar with the instant disclosure of the subject invention, may recognize additions, deletions, modifications, substitutions and/or other changes which will fall within the purview of the subject invention and claims.

We claim:

1. A variable bearing assembly for a jack-up platform having a hull, at least one support leg operable to extend from the hull to a seabed to support the hull above the surface of the sea and means to selectively effect relative vertical movement between the hull and leg, said variable bearing assembly comprising:

bearing means, operable to surround the support leg at a distal end thereof remote from said hull when the support leg is in an extended position, for selective bearing engagement with the seabed;

at least one longitudinally elongate recess fashioned into the support leg at a position above but adjacent to the distal end of the support leg;

means, mounted on said bearing means, for engaging said at least one longitudinally elongate recess fashioned into the support leg for connecting said bearing means to the support leg and concomitantly permitting a degree of longitudinal relative motion between said bearing means and the support leg at the distal end of the support leg such that the support leg may extend into the seabed downwardly of the position of said bearing means; and means for releasing said means for engaging said at least one longitudinally elongate recess of the support leg such that the support leg may be selectively released from said bearing means on the seabed and withdrawn to the platform hull.

2. A variable bearing assembly for a jack-up platform as defined in claim 1 wherein said bearing means comprises:

a bearing member for bearing against the seabed and having an aperature therein operable to receive the support leg through the bearing member and into the seabed; and a guide member mounted upon said bearing member and surrounding the support leg for providing sliding guidance of the bearing means longitudinally along the support leg at the distal end of the support leg.

3. A variable bearing assembly for a jack-up platform as defined in claim 2 wherein said means for engaging comprises:

at least one pin mounted upon said bearing means in a posture transverse to the longitudinal axis of the support leg.

4. A variable bearing assembly for a jack-up platform as defined in claim 3 wherein said means for releasing comprises:

means connected to said bearing means for translating said at least one pin toward and away from said elongate recess of the support leg to selectively engage and disengage said bearing means with the support leg.

5. A variable bearing assembly for a jack-up platform as defined in claim 2 wherein:

the support leg comprises a generally hollow cylindrical column; and said at least one elongate recess comprises at least one longitudinally elongate aperature cut through the wall of said generally hollow cylindrical column.

6. A variable bearing assembly for a jack-up platform as defined in claim 5 wherein said at least one longitudinally elongate aperature comprises:

a plurality of elongate aperatures cut through the wall of said generally hollow cylindrical column at symmetrical peripheral locations about the distal end of said cylindrical column.

7. A variable bearing assembly for a jack-up platform as defined in claim 6 wherein said means for engaging comprises:

a plurality of pins corresponding in number and location on said bearing means to said elongate aperatures cut through the wall of said cylindrical column and being mounted upon said bearing means for radial actuation with respect to said cylindrical column.

8. A variable bearing assembly for a jack-up platform as defined in claim 7 wherein said means for releasing comprises:

mechanical means mounted upon said bearing means and providing a mechanical advantage for actuation of said pins.

9. A variable bearing assembly for a jack-up platform as defined in claim 8 wherein said mechanical means comprises:

rack and pinion gear means operable to radially translate said pins with respect to said cylindrical column upon vertical motion of the rack portion of said rack and pinion gear means.

10. In a jack-up platform having a hull, a plurality of support legs operable to extend from the hull downwardly for selective bearing engagement with a seabed for supporting the hull above the surface of the sea and means to selectively effect relative vertical movement between the hull and legs, each support leg having a variable bearing assembly comprising:

bearing means for selective bearing engagement with the seabed around the support leg and being connected to a distal end of the support leg, said bearing means including, a bearing member for bearing against the seabed around the support leg and having an aperture therein operable to receive the support leg through the bearing member and into the seabed downwardly of the operative bearing position of the bearing member; and guide means mounted upon said bearing member and surrounding the support leg for providing sliding guidance of the bearing member longitudinally along the support leg at the distal end of the support leg; and means for interconnecting said guide means and the support leg such that said bearing means is carried by the support leg at the distal end thereof and said means for interconnecting providing longitudinal lost motion between said guide means and the support leg such that the bearing means may firmly engage the seabed in a supporting posture while the support leg may concomitantly cut into the seabed downward of the position of the bearing means.

11. In a jack-up platform having a variable bearing assembly upon each support leg as defined in claim 10 wherein said means for interconnecting comprising:

at least one pin means connected to one of the support leg and said guide means and projecting therefrom; and at least one longitudinal recess means fashioned within the other of the support leg and said guide means for receiving said at least one pin means and for providing a degree of lost motion longitudinal travel between the support leg and said guide means.

12. In a jack-up platform having a variable bearing assembly upon each support leg as defined in claim 11 wherein:

the support leg comprises a hollow cylindrical member;

said guide means comprises a cylindrical member mounted about the distal end of support leg;

said at least one pin means comprises a plurality of pin means connected to said guide means and being uniformly spaced about the periphery of said guide means; and said at least one longitudinal recess comprising a plurality of longitudinal aperatures fashioned through the wall of the cylindrical support leg and said aperatures being located in a posture to receive corresponding pin means connected to said guide means.

13. In a jack-up platform having a variable bearing assembly upon each support leg as defined in claim 12 wherein said plurality of pin means each comprise:

a bearing pin extending through said guide means cylindrical member; and means mounted upon said bearing means for extending and retracting said bearing pin with respect to said guide means and thus being operable for engaging and disengaging said bearing means with the support leg.

14. In a jack-up platform having a variable bearing assembly upon each support leg as defined in claim 13 wherein said means for extending and retracting comprising:

mechanical means mounted upon said bearing means and providing a mechanical advantage for actuation of said pin.

15. In a jack-up platform having a variable bearing assembly upon each support leg as defined in claim 14 wherein said mechanical means comprises:

rack and pinion gear means operable to radially translate said pin with respect to said cylindrical guide member upon vertical motion of the rack portion of said rack and pinion gear means.

* * * * *